United States Patent [19]

Allen et al.

[11] 4,036,471

[45] July 19, 1977

[54] UPHOLSTERY AND THE LIKE STAPLE REMOVER

[76] Inventors: Timothy Darrell Allen, 567 Santiago Ave.; Weston Hamaker, 309 Arcade Blvd., both of Sacramento, Calif. 95815

[21] Appl. No.: 691,097

[22] Filed: May 28, 1976

[51] Int. Cl.[2] ..... B25C 11/00

[52] U.S. Cl. ..... 254/28

[58] Field of Search ..... 254/26, 28, 131; 81/3 R; 145/21, 1 R, 1 A, 1 B; 7/8, 12

[56] References Cited

U.S. PATENT DOCUMENTS

| | | | |
|---|---|---|---|
| 1,130,147 | 3/1915 | Coles | 254/25 |
| 1,341,759 | 6/1920 | Peterson | 254/25 |
| 1,966,298 | 7/1934 | Jacobs | 254/28 |
| 2,711,109 | 6/1955 | Gillstrom | 254/28 |
| 2,719,358 | 10/1955 | Lassen | 81/3 R |
| 3,825,226 | 7/1974 | Appleman | 254/28 |

*Primary Examiner*—James L. Jones, Jr.
*Assistant Examiner*—Robert C. Watson
*Attorney, Agent, or Firm*—Mark C. Jacobs

[57] ABSTRACT

A staple remover comprising a handle having a main shaft affixed thereto at about a 70° angle, mounted on said shaft is a finger retaining means, wherein said shaft tapers to a point having a slot therein in a plane substantially parallel to mid-handle, and angularly affixed to said shaft is a second shaft which terminates in a slit point.

10 Claims, 4 Drawing Figures

UPHOLSTERY AND THE LIKE STAPLE REMOVER

BACKGROUND OF THE INVENTION

This invention relates to staple removers primarily for use by upholsterers. The use of staple pullers or removers is a basic operation in the upholstery and reupholstery business. Such tools are employed to remove staples and upholstery tacks from previously upholstered furniture, such as chairs, sofas and the like.

One such unit available today is that sold by George W. Mount of Greenfield, Massachusetts. Such a unit comprises a handle, a shaft interconnected at one end to said handle, wherein the two parts are aligned along the same longitudinal axis, said shaft having a straight portion protruding in a horizontal plane from said handle, a first bent portion, bent at an angle of about 45° downwardly from the horizontal, and a second bent portion directed upwardly from said first bent portion at about 135° angle and terminating in a rectangular head section having a slot therein parallel to the plane of said head section as shown in FIG. 4.

Another available staple remover is that of Berry as disclosed and claimed in U.S. Pat. No. 3,310,288.

Neither of these units conforms easily to the grip of the hand of the operator. In the Mount unit, due to the lack of a tapered head, it is often difficult to get down under a staple that is deeply embedded into the cloth and frame to remove it. Berry suffers from the fact that removal of the staple is a two step operation. One first crimps the staple, then rotates the device 90° to remove the staple. It is seen that due to the lack of expertise of the operator, that the crimping could have an effect of driving the staple in deeper on one side, prior to removal. Reference is made to the cited patent figures and figure description on this point.

SUMMARY OF THE INVENTION

The present invention involves a new staple removing apparatus comprising a handle having a shank portion angularly secured away from said handle at one end thereof and positioned at less than the midpoint on said handle, said shank having a finger retaining means secured thereto, and said shank terminating in a conical shaped portion with a slit dividing the cone in the central plane thereof. A secondary shank portion also terminating in a slit cone as appended to the shank in an angular manner.

Accordingly, it is an object of this invention to define a novel staple removing apparatus.

It is an object of this invention to provide a new and improved staple remover.

Another object of the invention is to provide a new and improved tool for removing staples from objects in which they are secured, such as wooden furniture framework, cardboard boxes, and the like.

It is a still further object of the invention to provide a staple remover which is manipulated by oone hand of an operator.

An additional object of the invention is to provide a staple remover comprising a handle, a shaft, and a head protion adapted to pry a staple from engaging relationship in an object and releasably firmly engage the staple while the staple is being lifted from the object.

Additional objects and advantages of the invention will be readily apparent from the reading of the following description of a device constructed in accordance with the invention, and reference to the accompanying drawings, thereof, wherein like numbers refer to like parts.

Figure 1:
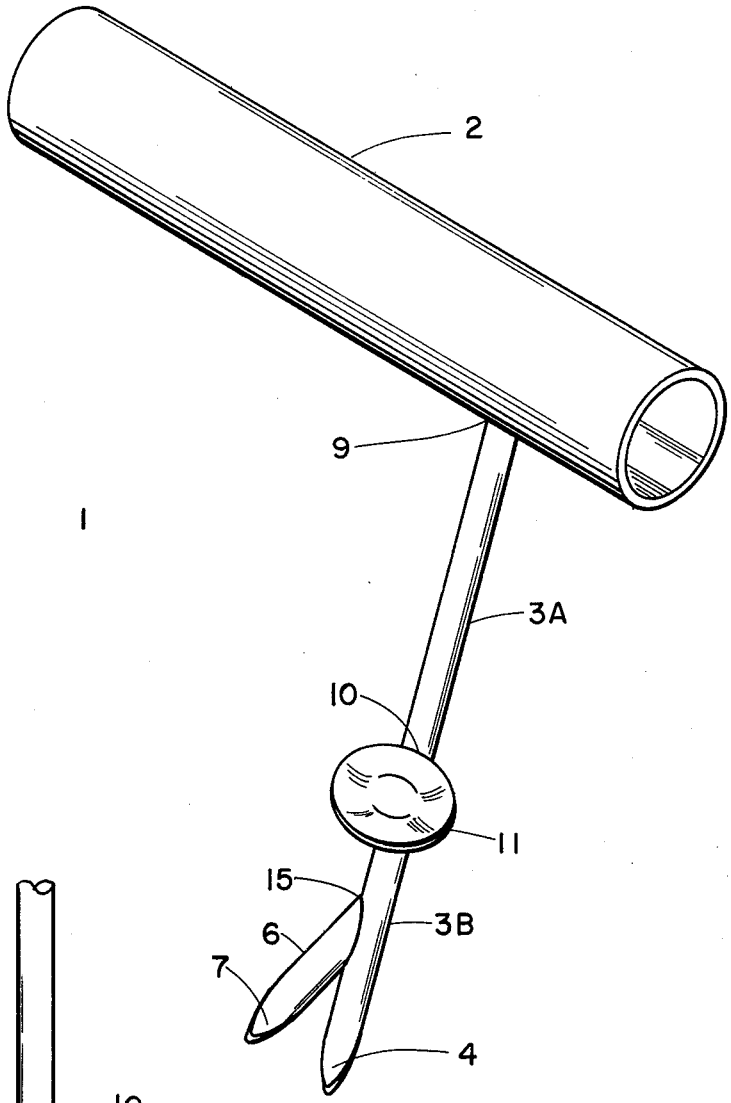
FIG. 1 is a perspective view of the staple remover of this invention.
Figure 2:
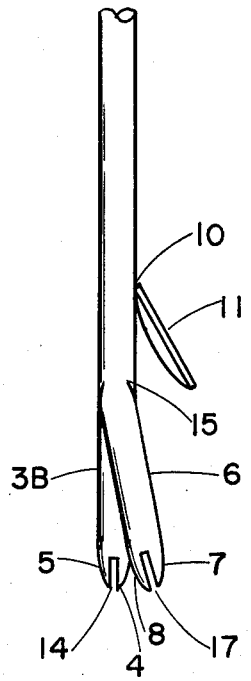
FIG. 2 is a front elevational view of the inventive device, fragmented to exclude the handle.

Referring to the drawings, the staple remover 1 comprises a handle 2, a main shaft 3 having a top portion **3*a* and a bottom portion 3*b*, a finger retainer 11, and a secondary shaft 6**.

The handle is generally tubular and can be made of plastic or metal, such as steel or aluminum, or even hard rubber so long as the material is substantially rigid so as to allow the main shaft to be permanently secured thereto. A handle 4 to 6 in length has been found suitable.

Main shaft 3 has either a rectangular or circular cross-section for the top portion **3*a*, and the same for the bottom protion 3*b* as is seen in the figures. The shaft is mounted at any angle up to 90° from the plane of the handle 2. It is seen that 70° is the preferred angle. The main shaft 3 is positioned in about the same horizontal plane as the handle 2** and may be made of a rigid high strength plastic such as polycarbonate, or metal such as steel or aluminum. The shaft may be angularly secured as by welding, or by the use of an applicable adhesive or other known means.

The main shaft is attached at a point positioned in about ¼ the length of the handle and designated 9, with the 70° angle formed between the short section of the handle and the main shaft and in a place coincident to a bisection of the handle's midpoint. Thus, if the handle were a round tube, shaft 3 would constitute a secant to the tube width.

Bottom portion **3*b* terminates in two extending equal portions 4 and 5, which taken together define a cone with a slit 14 dividing the cone in its central plane. The apex of the cone being situated at the tip of said extending portions. Bottom portion 3*b* constitutes that portion of shaft 3 from junction 15 to the tip of extending portions 4 and 5**.

Secondary shaft 6 is secured to main shaft 3 at junction point 15. Shaft 15 may be rectangular, square or circular in cross-section, and made of any suitable plastic or metal. Preferably, shaft 3 and shaft 6 are of the same cross-section both size- and shape-wise. Such construction is cost limiting. Typically, the secondary shaft is about ¼ tool steel round stock about one inch long joined by welding the circular end to the main shaft. The opposite end thereof terminates in two extending parts 7 and 8 which taken together define a cone with slit 17 dividing the cone in its central plane with the apex of the cone being at the free ends of said extending parts.

The secondary shaft 6 is fixedly secured to the main shaft 3 at an angle of from about 25° to 40° with 30° being preferred at junction point 15. It is seen that this junction is not in the same horizontal plane as the main shaft, but rather at an elevation of about 10° . Slit 17 is aligned parallel to the length of shaft 6. Shaft 6 is affixed to main shaft 3 on the longer side of the handle relative to the junction point 9. The length of shaft 6 is preferably substantially equal to shaft portion 3*b* as measured from junction 15.

Finger retainer 11 is fixedly secured to the main shaft at least one end thereof at junction 10 as by welding or gluing. Finger retainer 11 may comprise a ¼ internal diameter metal washer. The angle of inclination of the position of retainer 14 is preferably about 35°. Junction 10 preferably is about the midpoint of said shaft 3.

Figure 3:
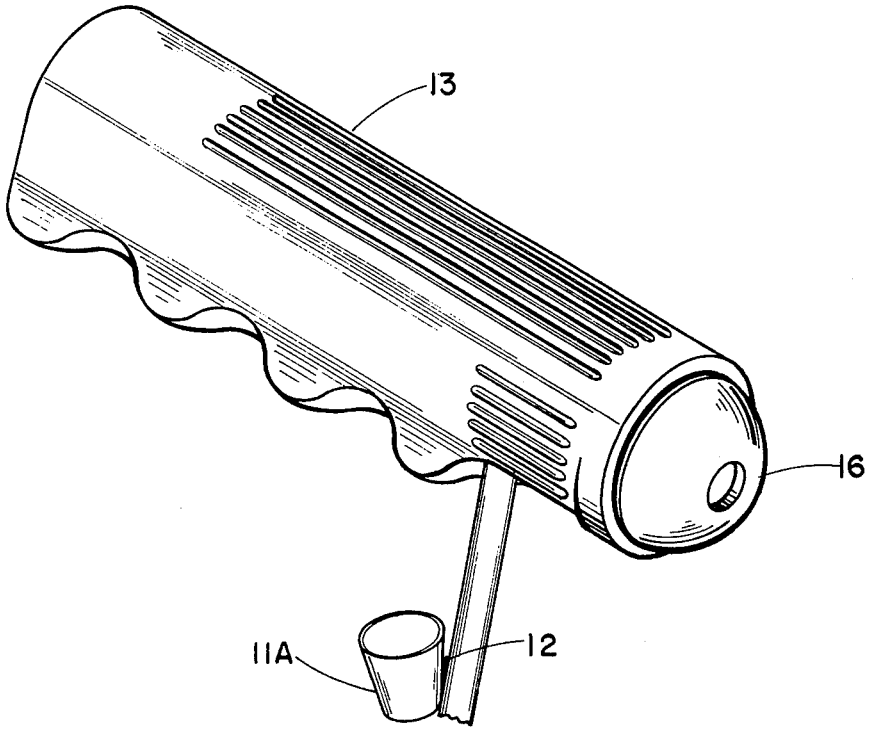
FIG. 3 is a perspective fragmented view of an alternate embodiment of the invention.
Figure 4:
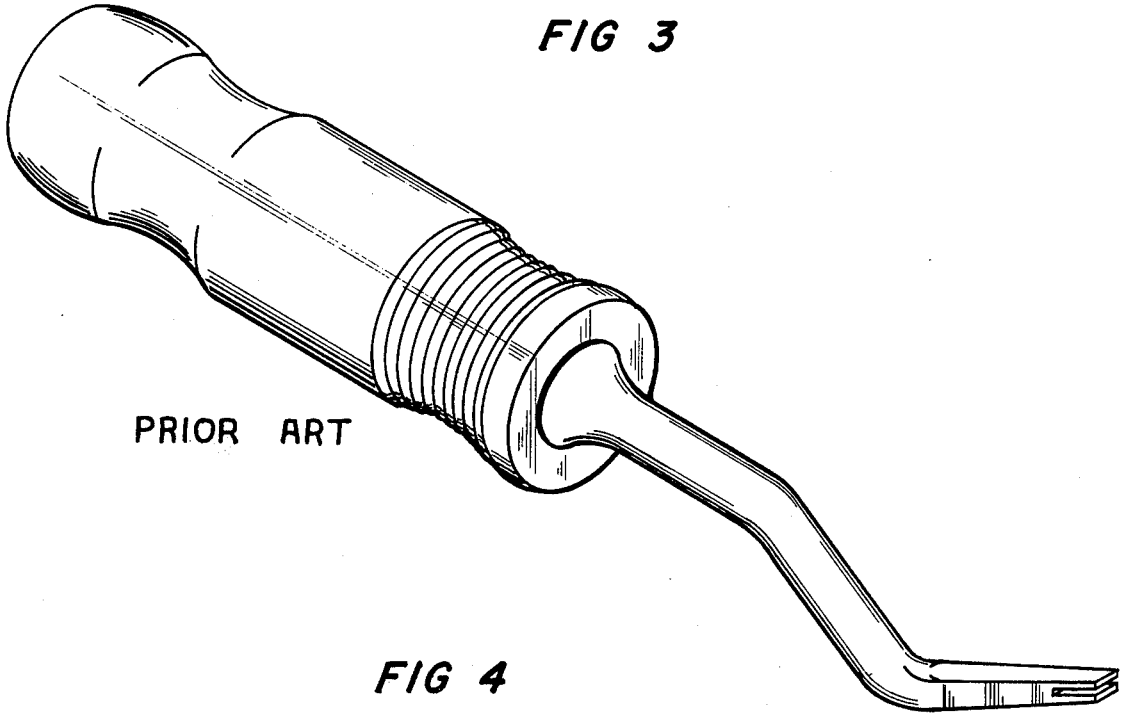
FIG. 4 is a perspective view of the prior art Mount device.

The alternate embodiment shown in FIG. 3 utilizes a standard thimble 11*a* used for serving as a finger retainer means. Another alternative for part 11 also, not shown, is a Vee-shaped teardrop that generally conforms to the shape of the index finger.

In FIG. 3, there is also shown a ball peen hammer face 16 affixed to the circular tubular handle across the diameter of one end of said handle. Not shown in a flat hammer face that can be substituted for the ball peen face or which could be employed across the oposite diameter of the handle, also not shown.

The retainer means is attached to shaft 3 between junction points 9 and 15, preferably at a location beyond the midpoint of the shaft 3, proximal the terminal portion 3*b*.

When the shaft 3 is of a different metal then the handle 2, it may be attached thereto by drilling a hole at the desired 70° angle at the desired location, and tapping such that when the shaft 3 is threaded it can be screwed into the hole in the handle and adhered into place as by the use of Plastic Steel or the like.

It is seen that while it has been disclosed that a square or round main shaft 3 can be employed, a round shaft is preferred at least for the distance between junction 15 and the tips 4 and 5, as this facilitates staple removal. While the overall length of shaft 3 is not critical, satisfactory results have been obtained wherein the shaft 3 is 4⅜ inches from junction 9 to the tip of extending portions 4 and 5.

It is also to be noted that a suitable length for slots 15 and 14 is within the range of from 1/16 to ¼ inch, preferably 0.06 inch.

A preferred handle 2 is up to 5 inches long, such as cold rolled steel. This may be optionally covered with leather or vinyl as shown in FIG. 3 to enhance gripability. An outside diameter of ⅞ has proven to be satisfactory.

In the embodiment of FIG. 3, there is seen a ball peen hammer face 16 made of suitable metal or plastic. Such may be attached by conventional means to the handle as by gluing, tapping and threading or the like. A smooth hammer face can be employed in place of the ball peen, or in addition to the ball peen, on the other side of the handle 2.

In another embodiment not shown, the shaft 3 is bent in a direction toward the finger retainer at some point along the shaft between junction points 10 and 15 in a direction toward the finger retainer. Obviously, the angle of bending cannot exceed the mounting angle for the retainer.

When the mode of construction and assembly is welding, all parts should be welded together at about 2600° C using conventional weld wire for steel.

While the extending portions of both shafts have been indicated to form conical structures having a slit therein, the desired staple removal can almost as easily be effected if the extending portions are cylindrical.

It is further to be seen that since the finger retainer is intended primarily for the index finger, that the embodiment herein is intended primarily for right-handed operators. However, a left-handed model, wherein the main shaft is mounted about 25% in along the handle length and extends in a generally rightwardly fashion, is also contemplated within the scope of the invention. Needless to say, on such a device the secondary shaft will be positioned in a similar angular relationship to the main shaft but on the opposite side thereof as by centrifugal force.

The staple remover is employed in a continuous integrated procedure for the removal of generally U-shaped staples, from a firm embedded relationship in bodies such as furniture, wood boxes, and the like. The initial step in the procedure of removing a staple with the staple remover is the engagement of the staple remover with the staple and the lifting or partial removal of the staple from the object in which it is secured. The staple remover is grasped firmly by the hand of the operator and positioned at an acute angle with the surface in which the staple is embedded, such that the extending portions 4 and 5 pass over and under the staple respectively such that the staple can communicate with and enter slit 14 and become releasably engaged therein.

After engagement of the staple, the operator revolves his hand to rotate the remover 1, with the right-handed model as depicted here, from left to right such that the left side of the handle is raised and the right side is lowered while all the time maintaining the index finger in the finger retainer 11. The main shaft thus revolves about its longitudinal axis at the same time. During the course of continued rotation, the secondary shaft 6 at least at its extending part 8 is brought into contact with the work surface into which the staple is embedded, while the main shaft's slit 14 moves accurately from an approximately horizontal to an almost vertical position. The secondary shaft upon contact with the work surface serves as a pivotal axis for the continued orientation of the main shaft which continues to move through an arc until such time as the staple is removed from the work surface by the lifting force being applied, by the top flat surface of protruding portion 4 upon the horizontal part of the surface of the staple with which it is in contact, until both legs of the staple are pulled completely free from the work surface. In some cases a final upward movement of the protruding portion 4 of shaft 3 may be necessary to completely effectuate staple removal, especially if one leg of the staple gets bent.

The freed or removed staple is then disengaged from its relationship with the tool by any suitable means. For example, it is manually forced forward to disengage it, or a suitable tool such as a screw driver may be employed to dislodge it from the tool if necessary.

In most instances manual removal is not necessary, as the staple will fly free from the slit 14 during the course of the arcing movement of the staple remover 1.

When a staple is positioned very close to a member or wall that is upstanding in relation to the work surface, it is seen that there may be no room for the normal operation of the tool 3, since adequate horizontal space between the staple and the upstanding member or wall may be lacking. In such instance the staple should be releasably engaged not within the slit 14 of the main shaft, but within the slit 17 of the secondary shaft. When using a left handed remover, such obstruction would be to the left of the normal engagement point of the staple with main shaft 3.

By orienting the hand of the operator from right to left in arcuate fashion after engagement of the staple, the main shaft's lower protruding part 5 and perhaps shaft portion 3b at time of staple engagement or soon thereafter during the arcurate travel of the handle's right side in an upwardly direction, will come in contact with the work surface and act as a pivotal axis for the continued travel of the secondary shaft in an arc segment wherein the slit 17 moves from an almost horizontal position toward an almost vertical alignment as it traverses a path moving from right to left. The index finger is positioned in the retainer during this operation.

The staple is either removed by centrifugal motion from the slit as it traverses its path, or it may be manually removed as previously described.

It is seen that for cosmetic purposes, the entire remover 1 can be chrome plated on the metal parts to enhance the saleability of the tool.

It will now be seen that a new and improved portable tool has been described and illustrated.

It will be seen that a new and improved staple remover has been described and illustrated which is useful for pulling staples from bodies in which they are secured, such as wooden furniture frameworks, cardboard boxes, and the like, even by the unskilled operator.

It is further to be seen that while the preferred embodiment discussed above has been shown to have an angular shaft having a slot therein, an alternative embodiment will lack said slot. Angular shaft 6, can also comprise a flattened out rectangular member of similar length to that shown in the figures, but optionally of greater width. In such a configuration, the upwardly facing edge thereof may be tapered sharply to form a cutting edge which the operator can employ for cutting upholstery, cardboard, for stripping fabric from the frame and the like. If a cutting edge is to be utilized, angular shaft will probably lack sufficient thickness to have a slot such as 17 cut therein, which would be capable of sustaining the force applied thereto in staple removal and is therefore not recommended, though it is within the scope of this invention to do so.

The foregoing description of the invention is illustrative only and changes in the details of the construction and operation may be made by those skilled in the art, without departing from the spirit of the invention.

What is claimed is:

1. A staple remover comprising:

a. A tubular handle, b. A main shaft affixed to the handle at a point in from one end of said handle at about a 70° angle to the length of said handle in a plane that bisects the midpoint of said handle, said shaft terminating at the opposite end in two extending portions which are spaced apart from the other to define a longitudinally extending slit for receiving a staple, wherein said extending portions taken together from a cone with the apex thereof at the free ends of said extending portions, c. A finger retaining mean secured at one end thereof to said shaft at about the midpoint of said shaft, d. A secondary shaft affixed to said main shaft at an angle of about 35° horizontally and about 10° vertically from said main shaft, and positioned on the shaft on the side thereof corresponding to the longer portion of said handle, relative to the attachment of said shaft to said handle, said secondary shaft terminating in a cone at the opposite end thereof and having a slit bisecting the apex of said cone longitudinally.

2. The staple remover of claim 1 wherein the finger retainer comprises an annulus secured at one point on said annulus to said shaft at about the midpoint of said main shaft.

3. The staple remover of claim 1 wherein the handle is wrapped with tape for more positive gripping power.

4. The staple remover of claim 1 wherein all parts are metallic and chrome plated.

5. A main shaft having two extending portions affixed thereto and extending longitudinally therefrom, said two portions being spaced one from the other to define a longitudinally extending slit for engaging a staple said shaft including a finger retaining means affixed thereto, shaft rotating means affixed at the opposite end of said shaft from said extended parts, a secondary shaft angularly affixed to said main shaft at a point between the attachment of the finger retainer and the tip of said shaft, wherein the shaft rotating means consists of a handle, and said handle is joined to said shaft at about a 70° angle at a point about ¼ of the distance in along said handle, and in a planar relationship to said handle coincident to a bisector of the midpoint of said handle, and said extending portions of said shaft taken together to form a cone, with a slit therein, the apex of the cone being at the tip of the portions.

6. A staple remover as in claim 5 wherein the finger retainer means is affixed at about the mid point of the shaft and depends therefrom at an upwardly angle of about 35°.

7. A main shaft having two extending portions affixed thereto and extending longitudinally therefrom, said two portions being spaced one from the other to define a longitudinally extending slit for engaging a staple, said shaft including a finger retaining means affixed thereto, shaft rotating means affixed at the opposite end of said shaft from said extended parts, a secondary shaft angularly affixed to said main shaft at a point between the attachment of the finger retainer and the tip of said shaft.

8. A staple remover as in claim 7 wherein the finger retainer means is affixed at about the midpoint of the shaft and depends therefrom at an upwardly angle of about 35°.

9. A main shaft having two extending portions affixed thereto and extending longitudinally therefrom, said two portions being spaced one from the other to define a longitudinally extending slit for engaging a staple, said shaft including a finger retaining means affixed thereto, shaft rotating means affixed at the opposite end of said shaft from said extended parts, a secondary shaft angularly affixed to said main shaft to a point between the attachment of the finger retainer and the tip of said shaft.

10. A staple remover as in claim 9 wherein the finger retainer means is affixed at about the midpoint of the shaft and depends therefrom at an upwardly angle of about 35°.

* * * * *